US008783776B1

(12) United States Patent
Perkins

(10) Patent No.: US 8,783,776 B1
(45) Date of Patent: Jul. 22, 2014

(54) INFLATABLE PILLOW FOR A CAR SEAT

(76) Inventor: Wade Perkins, Wasilla, AK (US)

( * ) Notice: Subject to any disclaimer, the term of this patent is extended or adjusted under 35 U.S.C. 154(b) by 321 days.

(21) Appl. No.: 13/204,185

(22) Filed: Aug. 5, 2011

Related U.S. Application Data

(60) Provisional application No. 61/371,055, filed on Aug. 5, 2010.

(51) Int. Cl.
*A47C 7/38* (2006.01)

(52) U.S. Cl.
USPC ..... 297/392; 297/219.12; 297/393; 297/397

(58) Field of Classification Search
USPC ..... 297/219.12, 392, 393, 397
See application file for complete search history.

(56) References Cited

U.S. PATENT DOCUMENTS

| | | | | | |
|---|---|---|---|---|---|
| 4,236,264 | A | * | 12/1980 | Britzman | 297/393 X |
| 4,776,049 | A | * | 10/1988 | Perron | 297/393 X |
| 4,786,080 | A | | 11/1988 | Jay | |
| 4,838,611 | A | | 6/1989 | Talaugon | |
| 5,005,903 | A | * | 4/1991 | Minardi | 297/219.12 |
| 5,056,533 | A | * | 10/1991 | Solano | 297/219.12 X |
| 5,064,245 | A | | 11/1991 | Stephens | |
| D322,380 | S | | 12/1991 | El-Asir | |
| 5,330,255 | A | | 7/1994 | Stawicki | |
| 5,505,523 | A | * | 4/1996 | Wang | 297/393 |
| 5,785,388 | A | | 7/1998 | Curtis | |
| 6,341,818 | B1 | * | 1/2002 | Verbovszky et al. | 297/219.12 |
| 6,457,195 | B1 | | 10/2002 | Holste | |
| 6,523,901 | B2 | * | 2/2003 | Smith | 297/392 |
| 6,554,363 | B1 | | 4/2003 | Silva | |
| 6,789,851 | B2 | * | 9/2004 | Smith | 297/392 |
| 7,017,212 | B2 | * | 3/2006 | Matthews Brown | 297/393 X |
| 7,234,771 | B2 | * | 6/2007 | Nakhla | 297/219.12 X |
| 7,252,330 | B2 | * | 8/2007 | Lincoln | 297/219.12 |
| 7,654,613 | B2 | * | 2/2010 | Bass | 297/219.12 X |
| 7,748,781 | B2 | * | 7/2010 | Bass | 297/219.12 X |
| 7,806,472 | B2 | * | 10/2010 | Runk et al. | 297/219.12 |
| 8,316,488 | B2 | * | 11/2012 | Rojas | 297/393 X |
| 8,419,128 | B1 | * | 4/2013 | Leach | 297/219.12 |
| 8,485,601 | B2 | * | 7/2013 | Fair et al. | 297/219.12 |
| 2003/0137177 | A1 | * | 7/2003 | Nyman | 297/397 |
| 2005/0173962 | A1 | * | 8/2005 | Stein et al. | 297/397 |
| 2006/0267392 | A1 | * | 11/2006 | Charnitski | 297/393 |
| 2007/0180623 | A1 | * | 8/2007 | Stein et al. | 297/397 X |
| 2008/0104764 | A1 | * | 5/2008 | Chen | 297/393 X |

* cited by examiner

*Primary Examiner* — Rodney B White
(74) *Attorney, Agent, or Firm* — Montgomery Patent & Design; Robert C. Montgomery

(57) ABSTRACT

An inflatable comfort means for a child car seat includes a pair of inflatable pillows each of which further comprises a cover and a fastening means. The pillows each comprise a kidney-shaped pillow with a soft exterior which provides comfort to a child occupying the child car seat. The fastening means comprises a pair of fabric strips provided with fasteners in order to allow the strips to removably attach to the straps of the child car seat and to removably secure the pillow in place. The inflating means is a user-activated means to inflate and deflate the pillow.

16 Claims, 9 Drawing Sheets

INFLATABLE PILLOW FOR A CAR SEAT

RELATED APPLICATIONS

The present invention was first described in and claims the benefit of U.S. Provisional Application No. 61/371,055 filed on Aug. 5, 2010, the entire disclosures of which are incorporated herein by reference.

FIELD OF THE INVENTION

The present invention relates generally to a pillow for a child, and in particular, to a pillow adapted to provide support to a child's head and neck while seated in a car seat.

BACKGROUND OF THE INVENTION

Infants are delicate beings, and they require the utmost care in order protect them and keep them safe from harm. One (1) of the most common items utilized to protect infants is a car seat. A car seat holds an infant in place to protect them while being transported in a motor vehicle.

A problem associated with conventional car seats is that they are generally ergonomically unfriendly and place more emphasis on restraint than comfort. In particular, the child's head tends to end up at awkward angles when the child is sleeping.

Prolonged placement of a child's neck and head at a poor angle causes a number of problems. This is uncomfortable for the child and can cause great distress when the child wakes. Furthermore, this causes a large amount stress on the child's neck which can cause strain and even damage. This is particularly dangerous in the event of a sudden stop or crash.

Various attempts have been made to provide support pillows adapted for use in a vehicle. Examples of these attempts can be seen by reference to several U.S. patents including U.S. Pat. No. 4,786,080; U.S. Pat. No. 4,838,611; U.S. Pat. No. 5,064,245; U.S. Pat. No. 5,330,255; U.S. Pat. No. 5,785,388; U.S. Pat. No. 6,457,195; and U.S. Pat. No. 6,554,363.

Additionally, ornamental designs for a neck support pillow exist, such as U.S. Pat. No. D 322,380. However, none of these designs are similar to the present invention.

While these devices fulfill their respective, particular objectives, each of these references suffer from one (1) or more disadvantages. Many such devices are not readily adjustable. Many such devices do not work for a child, particularly a sleeping child, as they assume a certain level of coordination on the part of the user. Many such devices are not easily adaptable for use with a car seat. Furthermore, many such devices are adapted for comfort but not support, or are not adapted to support and protect the neck and head of a sleeping child. Accordingly, there exists a need for a support pillow for a child in a car seat without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a support adapted for use by a child while in a car seat, which provides unconditional comfort and support in an easily installed and adjustable manner. Thus, the object of the present invention is to solve the aforementioned disadvantages and provide for this need.

To achieve the above objectives, it is an object of the present invention to provide a pair of pillows for supporting each side of a child's head in an upright position while the child is seated in a child car seat. Each pillow assembly comprises an inflatable pillow having a removable cover and a pillow strap for attached the device to a car seat.

Another object of the present invention is to removably attach each pillow assembly to a seat belt of a child car seat utilizing a strap attached to the attached to each pillow cover. The straps include fasteners that allow the straps to encircle and secure to the seat belt.

Yet still another object of the present invention is to comprise each pillow of a kidney-shape that provides a comfortable contoured surface conforming to the profile of a child's neck and lower head. The pillows provide upright support to both sides of the child's head and neck as well as forward support to the child's chin area to ensure that the child's neck remains at a safe and comfortable angle at all times, even while sleeping.

Yet still another object of the present invention is to comprise each inflatable pillow of a foam pillow having a nozzle for selectively inflating the pillow. Each nozzle comprises a vented cap valve that enables air to enter the foam body and remain within the body to maintain its expanded form. The nozzle can be opened to remove are from within the body until a desired level of support is achieved.

Yet still another object of the present invention is to comprise each cover of a removable fabric cover for providing comfort against a child's skin during use, providing protection to the inflatable pillow, and enabling removal of the cover for purposes of washing or replacement. Each cover further comprises a nozzle aperture enabling manipulation of the nozzles while the cover is in place.

Yet still another object of the present invention is to provide a method of utilizing the device that provides a unique means of attaching a pair of pillow assemblies onto respective seat belts using the straps; actuating the nozzles to inflate or deflate each pillow as desired; positioning a child with respect to the pillows such that the apparatus provides support to both sides of the child's head and neck areas; and, increasing the comfort and providing increased safety for the child.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
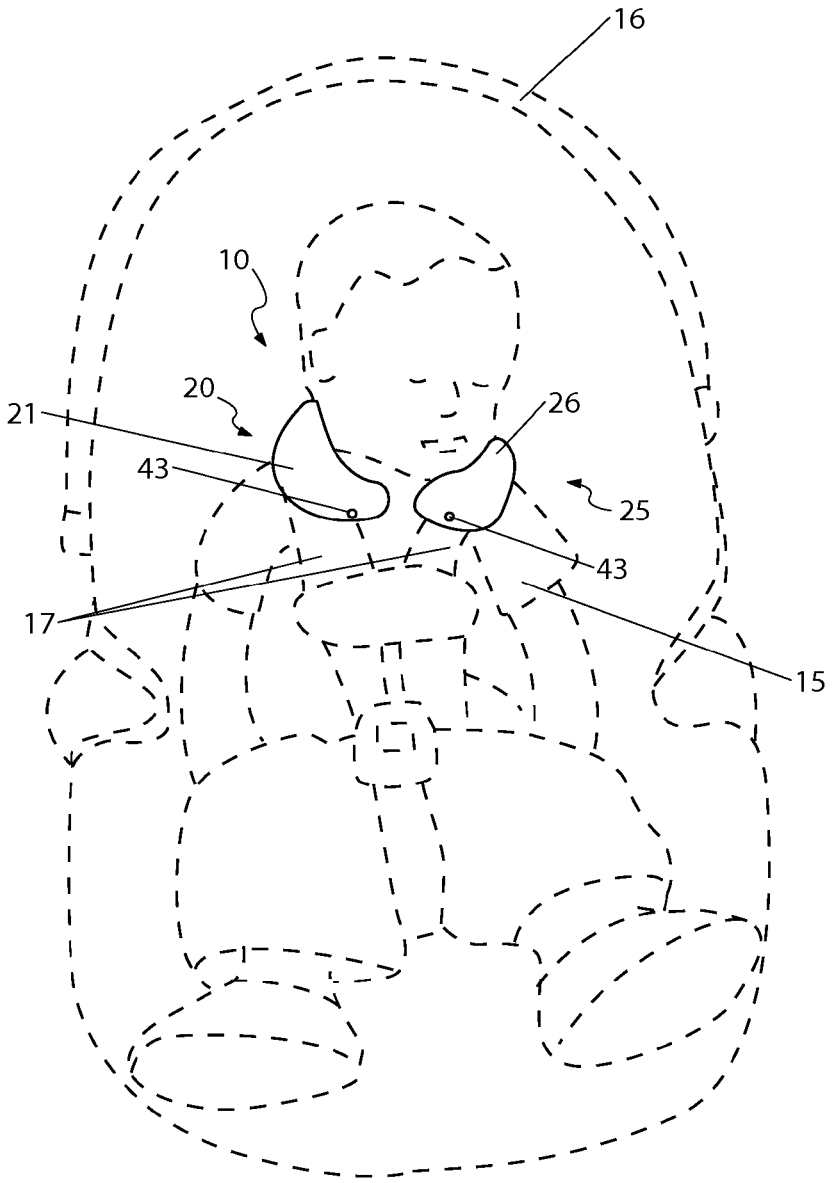
FIG. 1 is an environmental view of an inflatable comfort means for a child car seat 10, according to a preferred embodiment of the present invention.

10 inflatable pillow for a car seat
15 child
16 child car seat
17 seat belt
20 right pillow assembly
21 right pillow cover
22 right cover strap
23 right pillow aperture
25 left pillow assembly
26 left pillow cover
27 left pillow strap
28 left pillow aperture
29 securing feature
30 fastener
40 inflatable pillow
41 outer cover
42 foam body
43 nozzle
44 threaded portion

DETAILED DESCRIPTION OF THE PREFERRED EMBODIMENT

The best mode for carrying out the invention is presented in terms of its preferred embodiment, herein depicted within FIGS. 1 through 9. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an inflatable pillow for a car seat (herein described as the "apparatus") 10, particularly suited to be used as a pair of pillows for supporting each side of a child's 15 head in an upright position while the child 15 is seated in a child car seat 16. The apparatus 10 provides an increased level of comfort and protection to the child 15 while seated in the child car seat 16.

Figure 2:
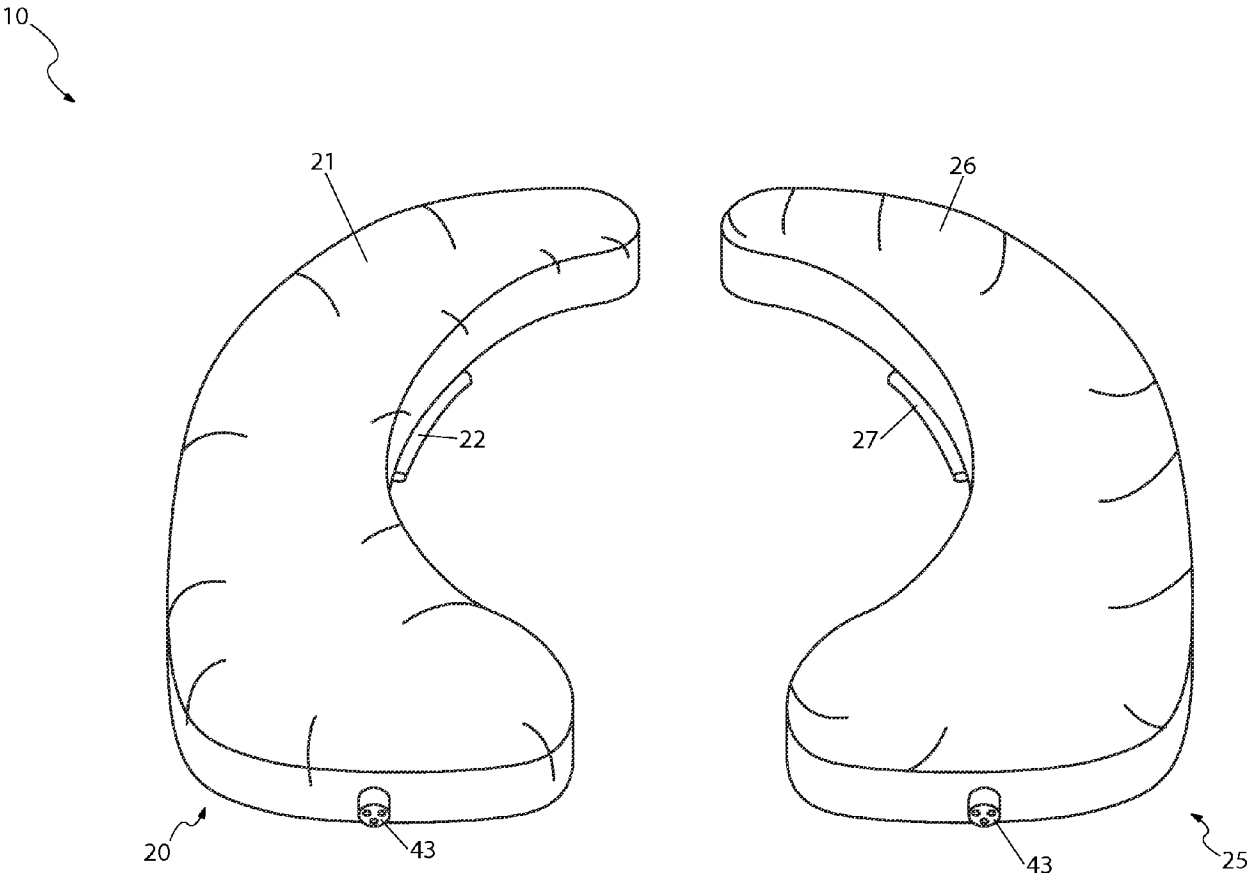
FIG. 2 is a perspective view of the inflatable comfort means for a child car seat 10 depicting an inflated right pillow assembly 20 and a deflated left pillow assembly 25, according to a preferred embodiment of the present invention.
Figure 3:
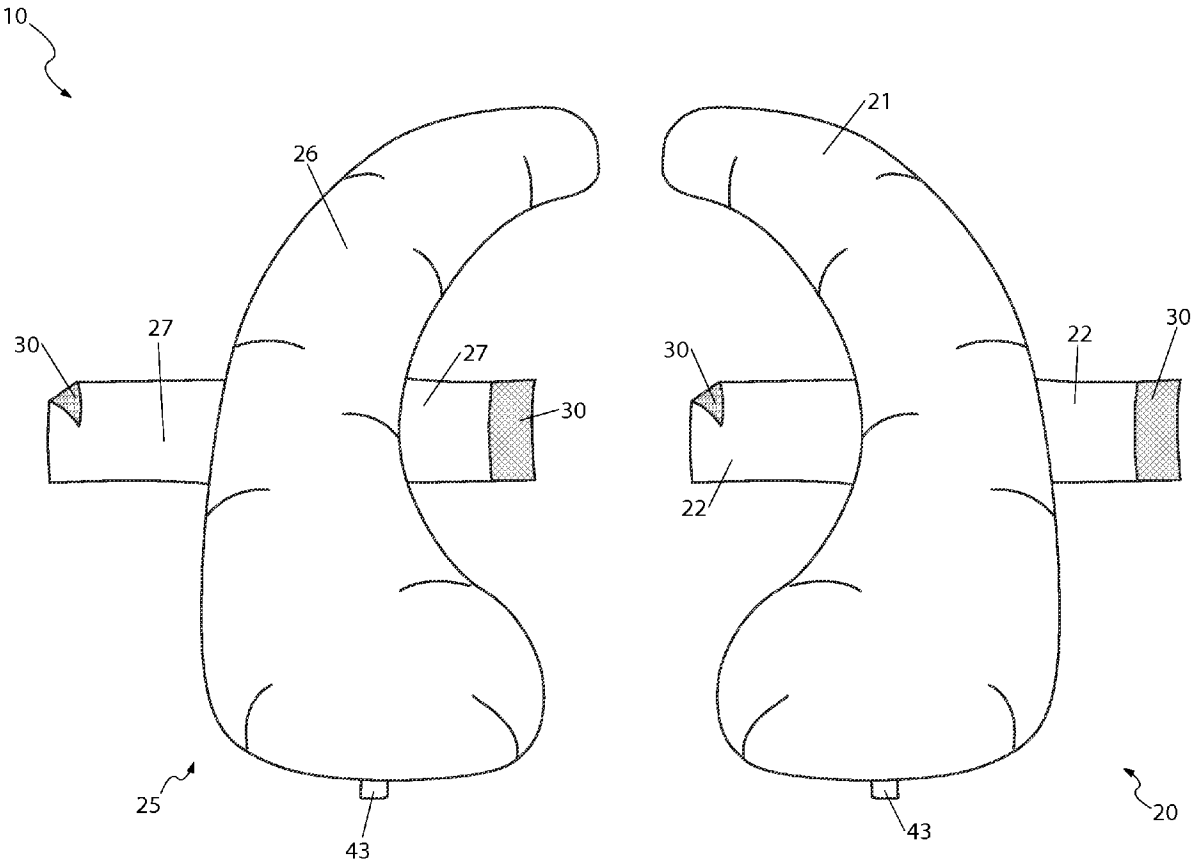
FIG. 3 is a rear view of the inflatable comfort means for a child car seat 10, according to a preferred embodiment of the present invention.

Referring now to FIG. 1, an environmental view of the apparatus 10, FIG. 2, a perspective view of the apparatus 10 depicting an inflated right pillow assembly 20 and a deflated left pillow assembly 25, and FIG. 3, a rear view of the apparatus 10, according to the preferred embodiment of the present invention, are disclosed. The apparatus 10 includes a pair of pillow assemblies 20, 25 each are removably attachable to a pair of seat belts 17. The pillow assemblies 20, 25 can be inflated or deflated via respective nozzles 43 as desired and as depicted in FIG. 2. Each of the pillow assemblies 20, 25 comprise a respective pillow cover 21, 26 and an inflatable pillow 40. The apparatus 10 is oriented on each shoulder of the child 15 to partially come in contact with the neck of the child 15. The apparatus 10 is to be positioned below the chin of the child 15 as to prop the chin upwardly in a comfortable position.

Figure 4:
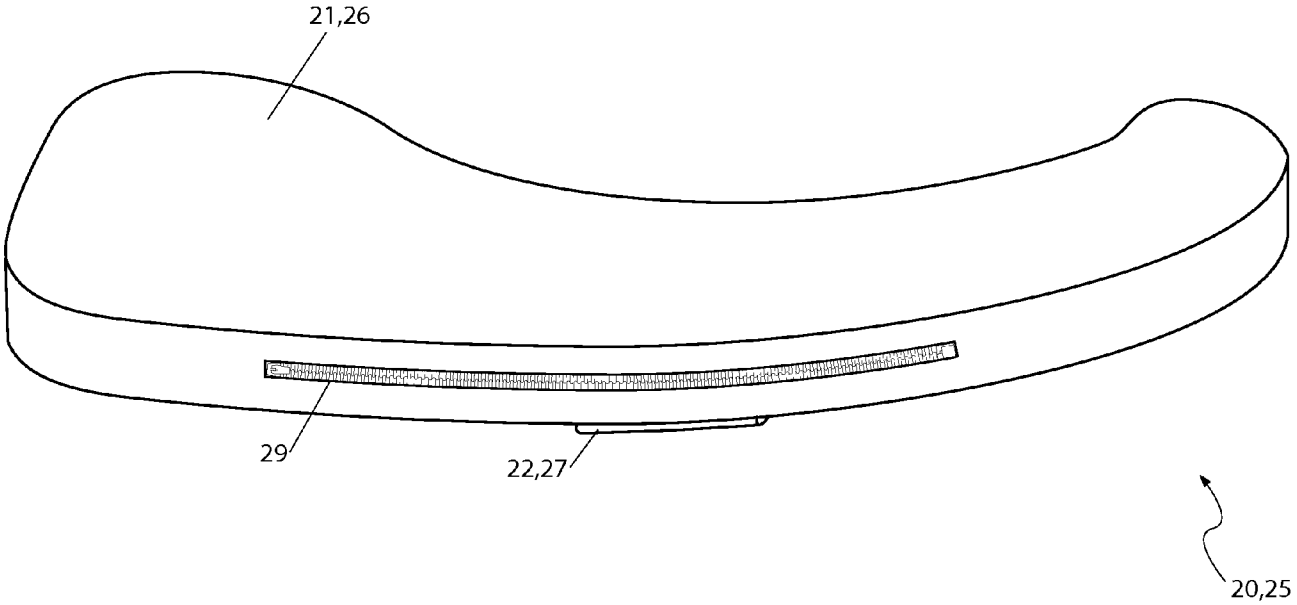
FIG. 4 is a side perspective view of the inflatable comfort means for a child car seat 10, according to a preferred embodiment of the present invention.
Figure 5:
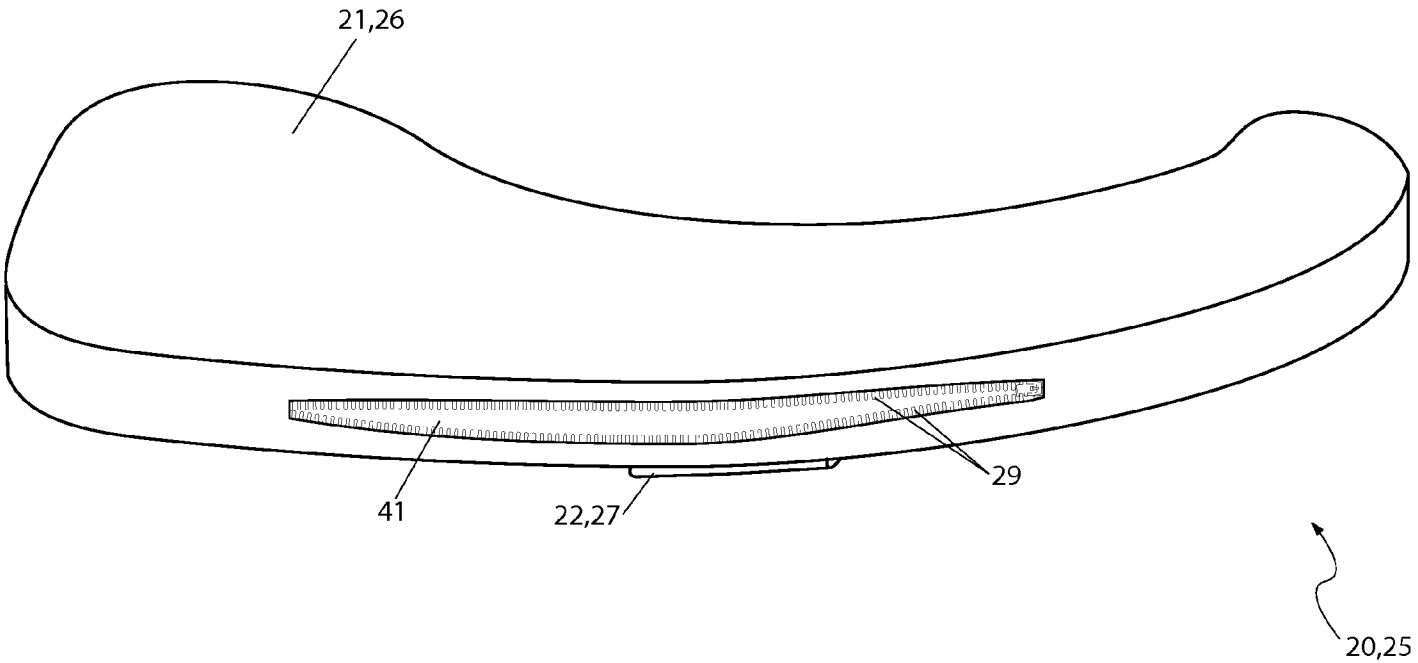
FIG. 5 is another side perspective view of the inflatable comfort means for a child car seat 10, according to a preferred embodiment of the present invention.
Figure 6:
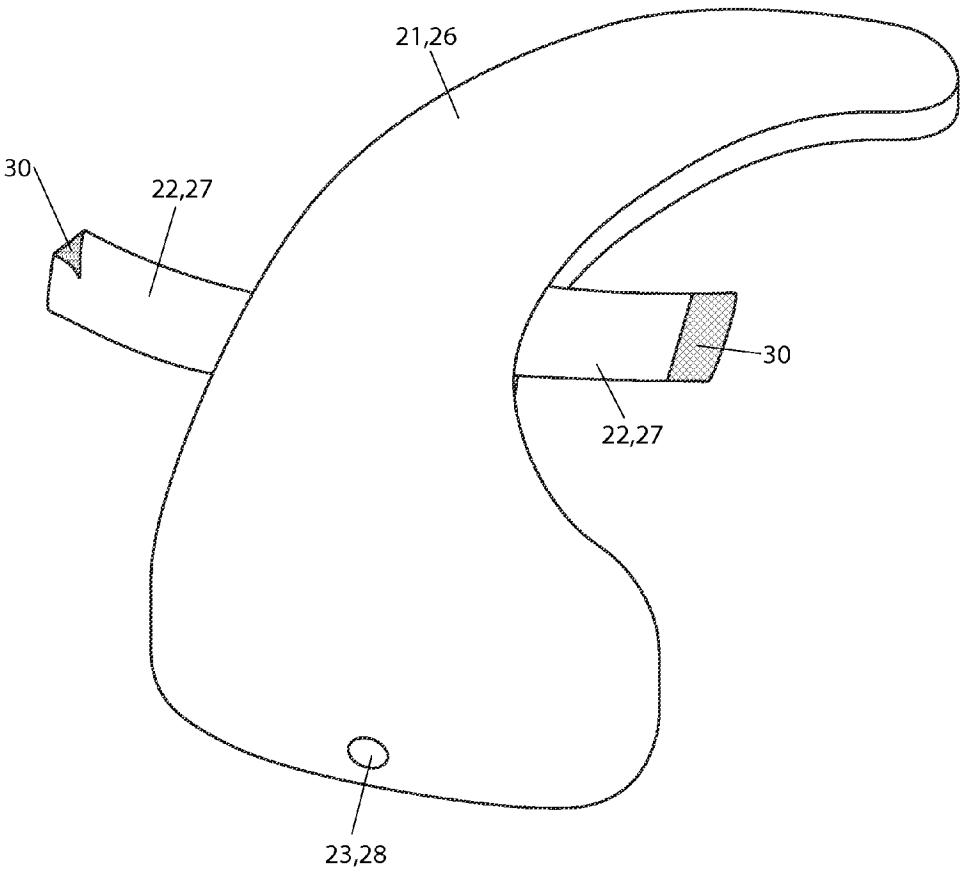
FIG. 6 is a front perspective view of a pillow cover 21, 26, according to a preferred embodiment of the present invention.

Referring now to FIG. 4, a side perspective view of the apparatus 10, FIG. 5, another side perspective view of the apparatus 10, and FIG. 6, a front perspective view of the pillow cover 21, 26, according to the preferred embodiment of the present invention, are disclosed. The apparatus 10 comprises a right pillow assembly 20 and a left pillow assembly 25 which are mirror kidney-shaped images of each other, thereby providing a matching fit to a child's 15 neck and facial areas. The right pillow assembly 20 includes a kidney-shaped right pillow cover 21 and the left pillow assembly 20 includes an opposing kidney-shaped left pillow cover 26. The pillow covers 21, 26 are removably attached from the respective inflatable pillow 40 with a securing feature 29 which is illustrated as a common zipper, yet other apparatuses can be utilized without limiting the scope of the apparatus 10. The pillow covers 21, 26 protect the inflatable pillow 40 from damage. Each pillow cover 21, 25 include a strap 22, 27 which wrap around the respective seat belt 17 for fastening the apparatus 10 to the desired position. The right cover strap 22 extends from opposing intermediate perimeter edges of the right pillow cover 21 and the left cover strap 27 extends from opposing intermediate perimeter edges of the left pillow cover 26. Each strap 22, 27 includes a fastener 30 which is preferably a hook-and-loop fastener to affix each assembly 20, 25 to the seat belt 17. The straps 22, 27 are attached to the respective pillow covers 21, 26 with sewing techniques. Each pillow cover 21, 26 is fabricated from a washable and durable fabric which is available in various colors and patterns. A front surface of the pillow covers 21, 26 includes a pillow aperture 23, 28 which enables a nozzle 43 to be exposed for manipulation of the inflatable pillow 40 (also see FIGS. 7 and 9).

Figure 7:
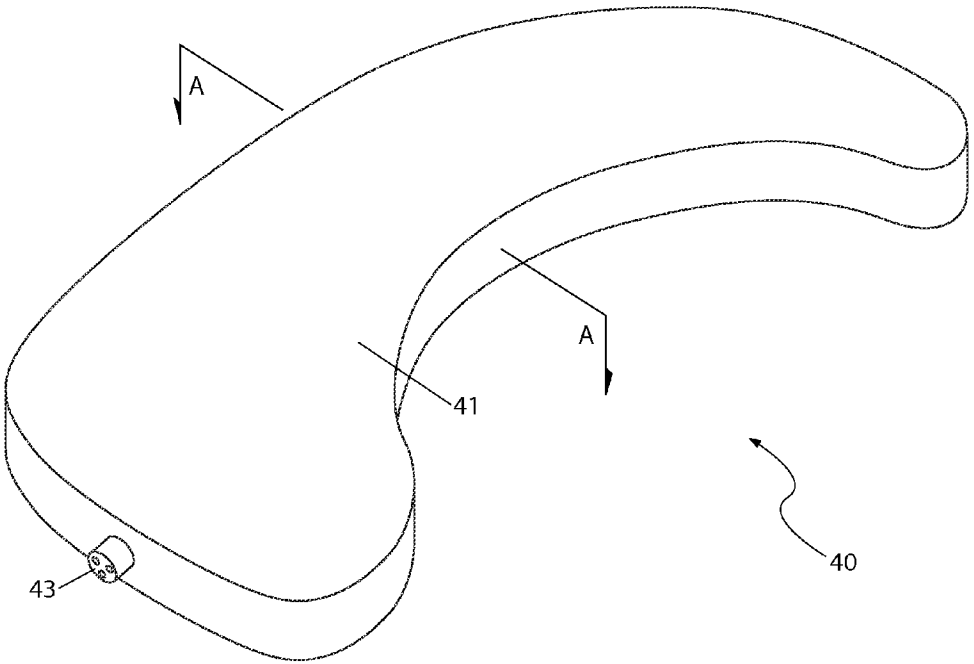
FIG. 7 is a perspective view of an inflatable pillow 40, according to a preferred embodiment of the present invention.
Figure 8:
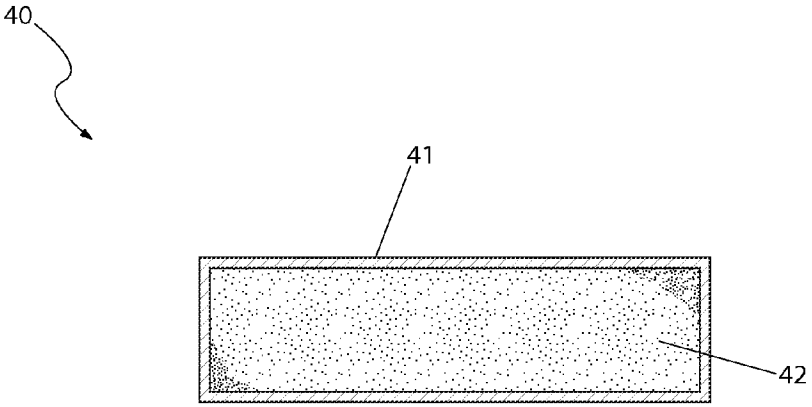
FIG. 8 is a section view of the inflatable pillow 40 taken along line A-A (see FIG. 7), according to a preferred embodiment of the present invention; and, FIG. 9 is a perspective view of the inflatable pillow 40 depicting a removed nozzle 43, according to a preferred embodiment of the present invention.
Figure 9:
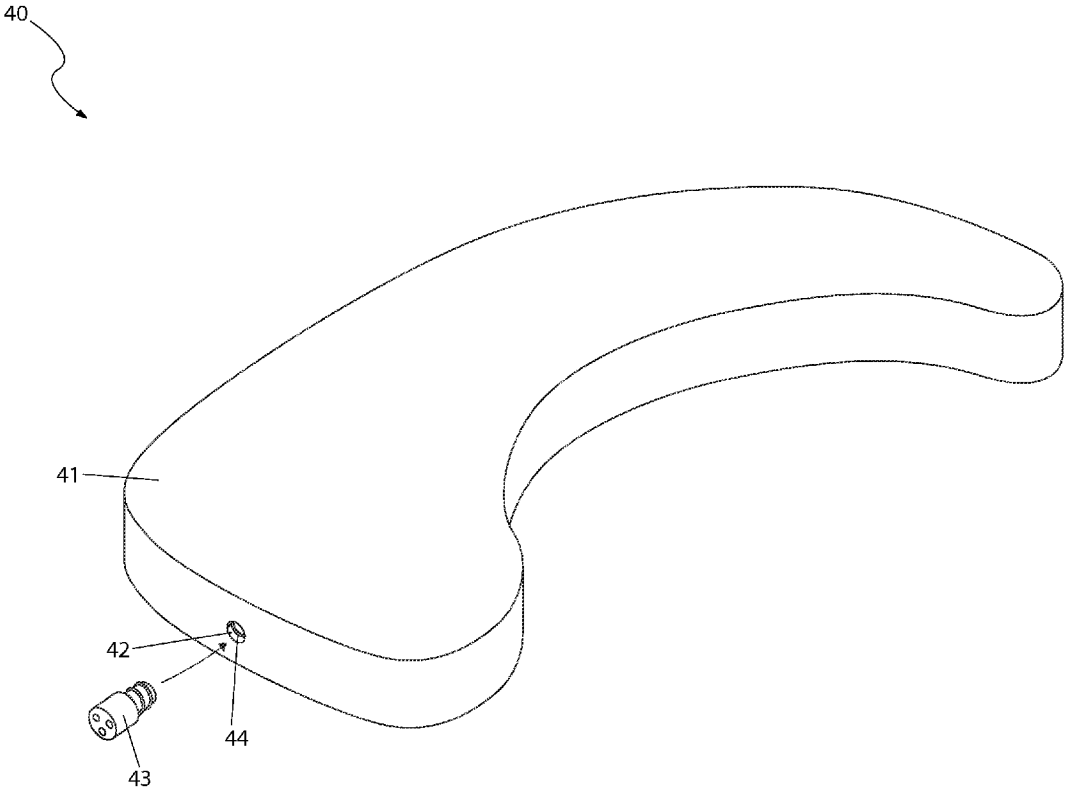

Referring now to FIG. 7, a perspective view of the inflatable pillow 40, FIG. 8, a section view of the inflatable pillow 40 taken along line A-A (see FIG. 7), and FIG. 9, perspective view of the inflatable pillow 40 depicting a removed nozzle 43, according to the preferred embodiment of the present invention, are disclosed. Each pillow cover 21, 26 envelops an inflatable pillow 40 which provides comfort to the child 15 and also maintains an upright position to the child's 15 head. The inflatable pillow 40 comprises a kidney-shaped foam body 42 which is fabricated from an open or closed cell polyurethane material similar to THERM-A-REST® mattress. The foam body 42 is covered with an outer cover 41 which further protects the foam body 42 and also enables the foam body 42 to expand with the addition of ambient air (see herein below). The outer cover 41 is fixed to the foam body 42 with sewing techniques.

Each foam body 42 includes a nozzle 43 which allows inflation and deflation. Each nozzle 43 is comprised of a vented cap valve which enables air to enter the foam body 42 and be retained within the inflated pillow 40 for inflation purposes and also enables the air to be released from the inflated pillow 40 as needed. The opening of the nozzle 43 allows air to enter an internal portion of the inflated pillow 40 which causes the open or closed cell polyurethane foam body 42 to expand and inflate. The nozzle 43 is the closed for the foam body 42 to maintain its expanded form. The nozzle 43 is secured to the outer cover 41 with an integral threaded portion 44 which enables the nozzle 43 to be replaced as needed. The nozzle 43 is opened to deplete air from the internal portion and enable the foam body 42 to deflate.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: acquiring the apparatus 10; attaching the right pillow assembly 20 onto the respective seat belt 17 via wrapping the right cover straps 22 around the seat belt 17 and engaging fasteners 30; attaching the left pillow assembly 25 onto the respective seat belt 17 via wrapping the left cover straps 27 around the seat belt 17 and engaging fasteners 30; rotating the nozzles 43 to enable air to flow through the and inflate each inflatable pillow 40 as desired; allowing the child 15 to rest upon each pillow assembly 20, 25; deflating each pillow assembly 20, 25 as desired via opening the pillow nozzles 43; and, increasing the comfort for a child car seat 16 bound child 15 with regards to head support and providing increased safety in a manner which is quick, easy and effective. Alternately, either the right pillow assembly 20 or the left pillow assembly 25 can be utilized individually.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An inflatable pillow, comprising:

a pillow cover, comprising a textile body having an outer protective surface and an opening bisecting said body and removably sealed with a pillow fastener, further defining an interior within;

a pair of straps, each having a proximal end affixed to opposing intermediate locations of longitudinal sides of said pillow cover and each having a strap fastener on a distal end;

an inflatable material disposed within said pillow cover interior; and, a nozzle in fluid communication with said inflatable material, extending outward through a pillow aperture;

wherein said nozzle is selectively activated to direct ambient air to expand said inflatable material or deflate said inflatable material;

wherein said inflatable pillow is adapted to be removably attached to a vehicle seat when said pair of straps encircle a portion of a seat belt of said vehicle seat and conjoin upon mating of said strap fasteners; and, wherein said inflatable pillow is adapted to support a head of an occupant in an upright position within said vehicle seat.

2. The inflatable pillow of claim 1, wherein said inflatable material further comprises a foam body interior covered by a foam body cover;

wherein said nozzle is in fluid communication with said foam body interior; and, wherein said foam body cover comprises a foam body cover aperture for permitting routing of said nozzle.

3. The inflatable pillow of claim 2, wherein said foam body interior further comprises an open or closed cell polyurethane material.

4. The inflatable pillow of claim 3, wherein said nozzle further comprises a vented cap valve removably secured to said pillow outer cover.

5. The inflatable pillow of claim 1, further comprising a generally kidney-shaped construction.

6. The inflatable pillow of claim 5, wherein said inflatable material further comprises a foam body interior covered by a foam body cover;

wherein said nozzle is in fluid communication with said foam body interior; and, wherein said foam body cover comprises a foam body cover aperture for permitting routing of said nozzle.

7. The inflatable pillow of claim 6, wherein said foam body interior further comprises an open or closed cell polyurethane material.

8. The inflatable pillow of claim 7, wherein said nozzle further comprises a vented cap valve removably secured to said pillow outer cover.

9. A pair of inflatable pillows, comprising:

a right-hand pillow, further comprising:

a right-hand pillow cover, comprising a textile body having an outer protective surface and an opening bisecting said body and removably sealed with a pillow fastener, further defining an interior within;

a pair of first straps, each having a first proximal end affixed to opposing intermediate locations of longitudinal sides of said pillow cover of said right-hand pillow and each having a first strap fastener on a first distal end;

a right-hand inflatable material disposed within said right-hand pillow cover interior; and, a right-hand nozzle in fluid communication with said right-hand inflatable material, extending outward through a pillow aperture;

a left-hand pillow, further comprising:

a left-hand pillow cover, comprising a textile body having an outer protective surface and an opening bisecting said body and removably sealed with a pillow fastener, further defining an interior within;

a pair of second straps, each having a second proximal end affixed to opposing intermediate locations of longitudinal sides of said pillow cover of said left-hand pillow and each having a second strap fastener on a second distal end;

a left-hand inflatable material disposed within said left-hand pillow cover interior; and, a left-hand nozzle in fluid communication with said left-hand inflatable material, extending outward through a pillow aperture;

wherein said right-hand nozzle is selectively activated to direct ambient air to expand said inflatable material or deflate said right-hand inflatable material;

wherein said left-hand nozzle is selectively activated to direct ambient air to expand said inflatable material or deflate said left-hand inflatable material;

wherein said right-hand inflatable pillow is adapted to be removably attached to a vehicle seat when said pair of first straps encircle a portion of a seat belt of a right-hand side of said vehicle seat and conjoin upon mating of said first strap fasteners;

wherein said left-hand inflatable pillow is adapted to be removably attached to a vehicle seat when said pair of second straps encircle a portion of a seat belt of a left-hand side of said vehicle seat and conjoin upon mating of said second strap fasteners; and, wherein both said right-hand inflatable pillow and said left-hand inflatable pillow are adapted to support a head of an occupant in an upright position within said vehicle seat.

10. The inflatable pillow of claim 9, wherein said right-hand inflatable material and said left-hand inflatable material each further comprises a foam body interior covered by a foam body cover;

wherein said right-hand nozzle is in fluid communication with said foam body interior of said right-hand inflatable material;

wherein said left-hand nozzle is in fluid communication with said foam body interior of said left-hand inflatable material;

wherein said foam body cover of said right-hand inflatable material comprises a foam body cover aperture for permitting routing of said right-hand nozzle; and, wherein said foam body cover of said left-hand inflatable material comprises a foam body cover aperture for permitting routing of said left-hand nozzle.

11. The pair of inflatable pillows of claim 10, wherein said foam body interior further comprises an open or closed cell polyurethane material.

12. The pair of inflatable pillows of claim 11, wherein both said right-hand nozzle and said left-hand nozzle further comprises a vented cap valve removably secured to said pillow outer cover of said right-hand pillow and said left-hand pillow, respectively.

13. The pair of inflatable pillows of claim 9, wherein each of said right-hand pillow and said left-hand pillow further comprises a generally kidney-shaped construction.

14. The pair of inflatable pillows of claim 13, wherein said right-hand inflatable material and said left-hand inflatable material each further comprises a foam body interior covered by a foam body cover;

wherein said right-hand nozzle is in fluid communication with said foam body interior of said right-hand inflatable material;

wherein said left-hand nozzle is in fluid communication with said foam body interior of said left-hand inflatable material;

wherein said foam body cover of said right-hand inflatable material comprises a foam body cover aperture for permitting routing of said right-hand nozzle; and, wherein said foam body cover of said left-hand inflatable material comprises a foam body cover aperture for permitting routing of said left-hand nozzle.

15. The pair of inflatable pillows of claim 14, wherein said foam body interior further comprises an open or closed cell polyurethane material.

16. The pair of inflatable pillows of claim 15, wherein both said right-hand nozzle and said left-hand nozzle further comprises a vented cap valve removably secured to said pillow outer cover of said right-hand pillow and said left-hand pillow, respectively.

* * * * *